US005456471A

United States Patent [19]

MacDonald

[11] Patent Number: 5,456,471

[45] Date of Patent: Oct. 10, 1995

[54] GOLF PRACTICE APPARATUS AND FABRICATING PROCESS

[76] Inventor: Donald K. MacDonald, 1180 Kilkare Rd., Sunol, Calif. 94586

[21] Appl. No.: 312,461

[22] Filed: Sep. 26, 1994

Related U.S. Application Data

[63] Continuation-in-part of Ser. No. 6,826, Jan. 21, 1993, Pat. No. 5,356,147, which is a continuation-in-part of Ser. No. 931,598, Aug. 18, 1992, abandoned.

[51] Int. Cl.[6] ..... A63B 69/36

[52] U.S. Cl. ..... 273/195 A

[58] Field of Search ..... 273/195 A, 195 R, 273/176 H, 187.1

[56] References Cited

U.S. PATENT DOCUMENTS

| | | | |
|---|---|---|---|
| 1,276,775 | 8/1918 | Lambert | 273/195 R X |
| 3,473,811 | 10/1969 | Lees | 273/195 R |
| 3,765,683 | 10/1973 | Landry | 273/195 B X |
| 4,092,027 | 5/1978 | Carter | 273/195 R |

*Primary Examiner*—George J. Marlo
*Attorney, Agent, or Firm*—Fliesler, Dubb, Meyer & Lovejoy

[57] ABSTRACT

An apparatus for practicing golf swings is provided having a pair of spaced parallel side members, a first cross member attached to an end of each one of the pair of side members, a second cross member attached to the opposite end of each one of the pair of side members in such a manner that the second cross member is free to be rotated relative to said opposite end of the pair of side members, a sheet of simulated grass material on a rectangular sheet of substantially inelastic material which is attached to the first and second cross members for supporting a golf ball and a mechanism for locking the second cross member in position relative to the ends of said side members after a predetermined amount of tension has been applied to the rectangular sheet of material by rotating the second cross member in a direction which results in applying tension to the rectangular sheet of material.

40 Claims, 6 Drawing Sheets

GOLF PRACTICE APPARATUS AND FABRICATING PROCESS

CROSS-REFERENCE TO RELATED APPLICATIONS

The present application is a continuation-in-part of application Ser. No. 08/006,826, filed Jan. 21, 1993, entitled GOLF PRACTICE TEE WITH RISERS, which is a continuation-in-part of application Ser. No. 07/931,598, filed Aug. 18, 1992, entitled APPARATUS FOR USE IN PRACTICING A GOLF SWING, now abandoned.

BACKGROUND OF THE INVENTION

1. Field of the Invention

The present invention relates to golfing apparatus for use in practicing golf swings in general and in particular to a method and apparatus for use in practicing a golf swing in which an iron or a wood is used for hitting "through" a golf ball in a manner which normally would result in making a divot in the natural turf of a golf course.

2. Description of the Related Art

Driving ranges are provided to enable golfers to practice their golf swings using their woods and their irons. A typical driving range comprises a rectangular plot of ground which may be 350 to 400 yards in length, or longer, space permitting, and of sufficient width to accommodate a number of golfers at the same time. Typically, each golfer is allotted a predetermined amount of practice space within which he or she can safely swing their club to hit a golf ball down the driving range. The golfer may hit their ball from a wooden or plastic tee or from the surface of the practice space. When the golfer uses a tee, the golfer's swing should be and usually is identical to that which the golfer uses during normal play. However, heretofore, when the golfer has not used a tee and has hit a ball from the surface of a practice space, the golfer usually has been required to adjust his or her swing to accommodate the conditions of the surface of the practice space.

The nature of the surface of the practice space can vary widely at any given driving range and from driving range to driving range. For example, the surface may comprise grass covered turf which is substantially identical to the conditions which the golfer would normally encounter on a conventional golf course fairway. Under such conditions the golfer can and normally would utilize his or her normal swing which, when using an iron and sometimes when using a wood, requires that the club head be driven downwardly and "through" the ball resulting in the making of a divot at the apex of the swing arc, i.e. the removal of an amount of turf from below the ball after the ball is struck. Unfortunately, such ideal conditions are not found at many driving ranges.

The surface of the practice space at many driving ranges which comprises turf is typically dry and hard, and riddled with divot marks after a short period of use, making it difficult to find a patch of useful grass or even a smooth surface on which to rest the ball. At other driving ranges, the surface of the practice space may comprise a hard rubber mat, with or without a simulated grass surface, or the like. Under such conditions, it has not been possible heretofore to practice swinging an iron or wood "through" a ball in a manner which usually would result in making a divot during a normal fairway shot.

Practice driving apparatus for home use is commercially available. Typically it comprises a mat from which a ball is struck and a net into which the ball is hit. As in the case of prior known commercial driving ranges which use a mat from which a ball is struck as discussed above, prior known home practice driving apparatus also does not ordinarily permit swinging an iron or a wood "through" a ball as is usually required during a normal fairway iron shot.

In applicant's prior U.S. Patent Applications identified above there is disclosed golf practice apparatus which closely simulates actual golf course fairway conditions comprising a number of different types of frame assemblies over which a golf ball supporting sheet is stretched utilizing resilient members, such as rubber bands or a plurality of spring members. In one embodiment thereof the supporting sheet is stretched by spring members or other elastic members between a pair of fixed cross-members in a rectangular frame. In another embodiment the supporting sheet is stretched by means of spring members or other elastic members over a pair of risers mounted to a pair of honeycomb-filled rails. In still another embodiment the supporting sheet is stretched over a gas filled bag within a frame.

An important feature of the prior known golf practice apparatus described above is that the supporting sheet comprises separate simulated grass and inelastic sheets which are bonded together and attached to the frames. Because of the manner in which the simulated grass sheet is bonded to the inelastic sheet it has been found that the lifetime of the simulated grass sheet is significantly extended.

However, to facilitate and reduce the cost of fabricating, packaging, shipping and assembling golf practice apparatus as described above, it is advantageous to reduce the number of parts therein to a minimum and to make the installation of the grass and inelastic supporting sheets and the tensioning thereof as quick and easy as possible.

SUMMARY OF THE INVENTION

In view of the foregoing, a principal object of the present invention is a golf practice apparatus comprising a rectangular frame assembly having a cross member for applying tension to a rectangular sheet of material attached thereto. The cross member is rotatable and the tension is applied to the sheet of material by rotating the cross member in a direction which results in applying tension to the sheet. Means are provided for locking the cross member in position after a selected amount of tension is applied to the sheet.

In one embodiment of the present invention the locking means comprises a plurality of notches in a fitting to which the rotatable cross member is fitted and a pin member on the cross member which is locked in a selected one of the notches after the desired amount of tension is applied to the sheet.

In another embodiment of the present invention the locking means comprises a plurality of holes in the rotatable cross member and in the fitting to which the rotatable cross member is fitted. After the desired amount of tension is applied to the sheet by rotating the cross member, a pin member is inserted in selected ones of the holes in the fitting and cross member which are in registration for locking the cross member in position.

In a preferred embodiment of the present invention a corresponding end of the sheet of material is removably inserted in a slot in the rotatable cross member and retained therein by wrapping a predetermined amount, e.g. 370 degrees, of the sheet around the cross member.

Preferably, the sheet of material comprises a composite of two sheets, a bottom sheet and a top sheet. The bottom sheet comprises a sheet of substantially inelastic material, such as nylon or lexan, to which is bonded a sheet of simulated grass material having its own backing. The bonding material is preferably an elastic adhesive or elastic threads. An elastic adhesive or elastic threads are used to allow for slight movement of the top sheet relative to the bottom sheet when the sheets are deformed. This relative movement is believed to significantly extend the lifetime of the simulated grass material.

In still other embodiments of the present invention, foam strips are bonded to the undersurface of the bottom sheet to provide a measure of resistance to vertical deformation of the sheets when they are struck with a golf club head to closer simulate actual fairway conditions.

BRIEF DESCRIPTION OF THE DRAWINGS

The above and other objects, features and advantages of the present invention will become apparent from the following detailed description of the accompanying drawings, in which.

DETAILED DESCRIPTION OF THE INVENTION

Figure 2:
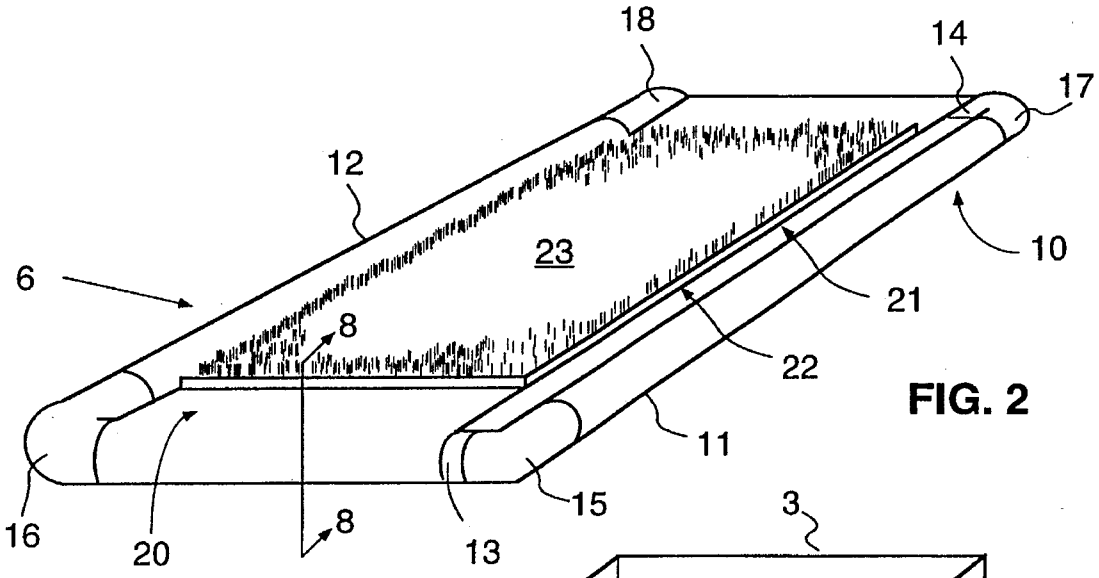
FIG. 2 is a perspective view of a golf practice apparatus frame with a rectangular sheet of simulated grass material bonded to a rectangular sheet of substantially inelastic material according to the present invention.
Figure 1:
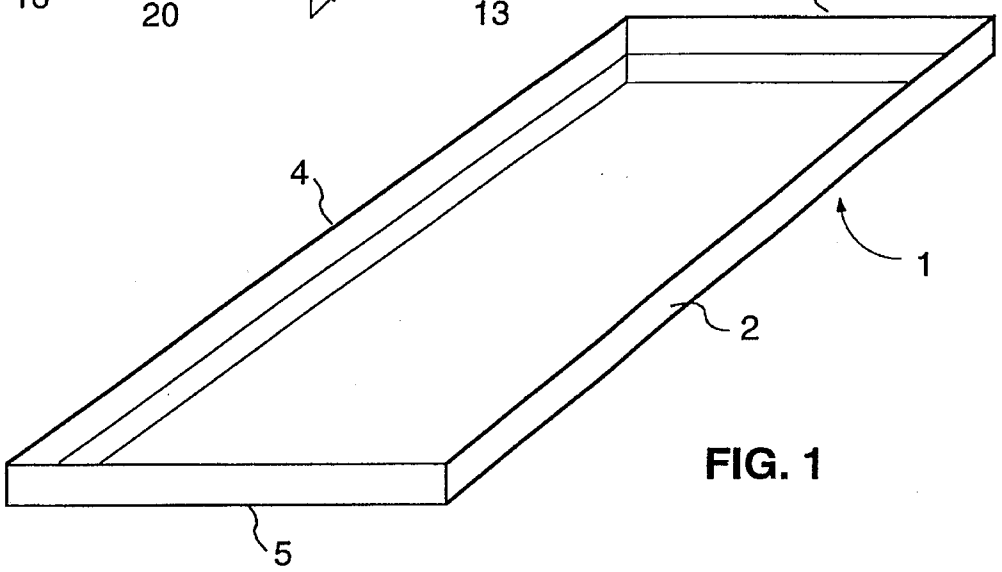
FIG. 1 is a perspective view of a golf practice apparatus enclosure according to the present invention.

Referring to FIGS. 1 and 2, there is provided a rectangular enclosure designated generally as 1 for enclosing and restraining the horizontal movement of a golf practice apparatus 6 according to the present invention. In the enclosure 1 there are provided four L-shaped members 2, 3, 4 and 5, which are joined at their respective ends to form the rectangular enclosure 1.

Referring to FIG. 2, there is provided in the apparatus 6 a frame assembly designated generally as 10 having a pair of side members 11 and 12 and a pair of cross members 13 and 14. Cross member 13 is fitted to the side members 11 and 12 by means of a pair of 90° elbows or fittings 15 and 16, respectively. Cross member 14 is fitted to the opposite ends of the side members 10 and 12 by means of 90° elbows or fittings 17 and 18, respectively. As will be further described below, cross member 13 is fixedly attached to fittings 15 and 16 and cross member 14 is fitted to fittings 17 and 18 in such a manner that the cross member 14 is free to rotate with respect thereto. Attached to cross members 13 and 14 is a substantially inelastic rectangular sheet of material 20. Sheet 20 typically comprises a material such as nylon or lexan.

Bonded to sheet 20 there is provided a rectangular sheet of simulated grass material designated generally as sheet 21. Sheet 21 comprises a backing 22 on which is fabricated simulated grass 23. The simulated grass sheet 21 may be, for example, grass known as PROTURF II, No. 4557-02, sold by General Felt Industries, Saddlebrook, N.J. As will be further described below, the simulated grass sheet 21 is bonded to the substantially inelastic sheet 20 by means of an elastic adhesive such as an elastic contact adhesive made by the 3M Corporation of Minneapolis, Minn., or by means of elastic threads (not shown). The reason for the use of an elastic bonding material is to allow relative movement between the simulated grass sheet 21 and the inelastic sheet 20 during a vertical deformation of the sheets when the sheets are struck by a golf club. It has been found that by allowing for the slight relative movement of the two sheets under such conditions, the lifetime of the simulated grass sheet is significantly increased.

Figure 3:
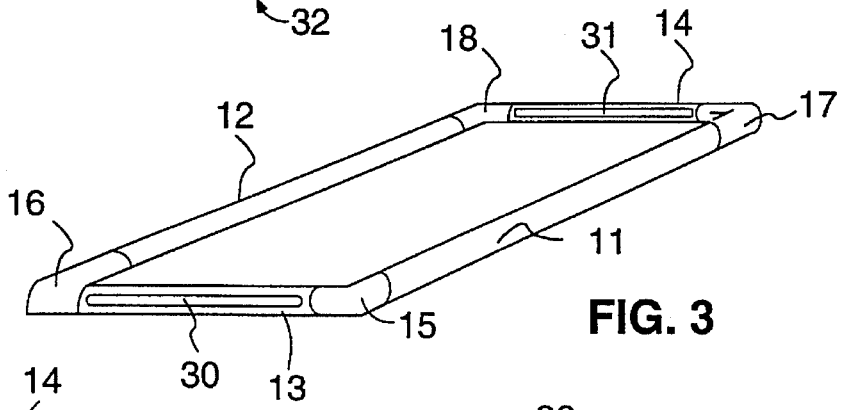
FIG. 3 is a perspective view of a golf practice apparatus frame comprising a pair of slotted cross members according to the present invention.

Referring to FIG. 3, each of the cross members 13 and 14 are provided with a slot 30 and 31, respectively.

Figure 4:
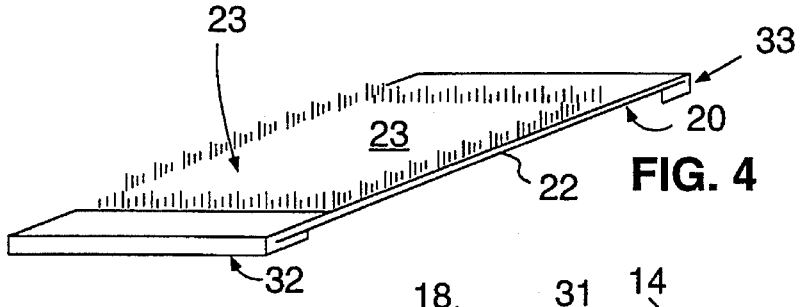
FIG. 4 is a perspective view of a rectangular sheet of simulated grass material having its own backing which is bonded to a sheet of inelastic material according to the present invention.

Referring to FIG. 4, the ends of the substantially inelastic sheet 20 are folded over and sewn or adhesively bonded to the undersurface of the sheet 20 so as to provide a hem 32 and 33 on each end thereof.

Figure 5:
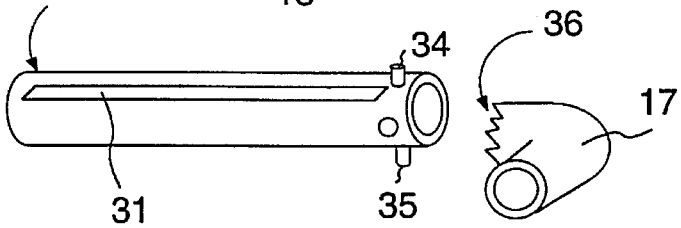
FIG. 5 is a perspective view of a rotatable slotted cross member and corresponding notched side member fitting according to the present invention.

Referring to FIG. 5, there is shown a slightly enlarged view of the cross member 14 and fitting 17 of FIG. 3. At the right end of the cross member 14 there is provided a pair of pin members 34 and 35. In the adjacent edge of the fitting 17 there is provided a plurality of sawtooth notches 36. As will be further described below, the pin members 34 and 35 cooperate with the notches 36 so as to lock the cross member 14 in position after the cross member has been rotated to apply a selected amount of tension to the substantially inelastic rectangular sheet of material 20.

Figure 6:
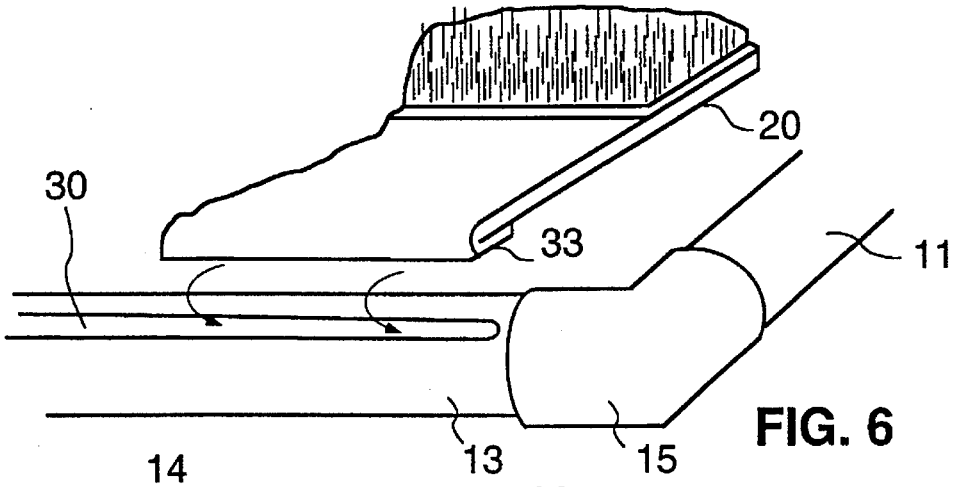
FIG. 6 is a perspective view of a composite sheet of simulated grass material bonded to a sheet of inelastic material being inserted in a slot in a cross member according to the present invention.

Referring to FIG. 6, during the assembly of the golf apparatus the hemmed end 33 of the sheet 20 is inserted in the slot 30. Thereafter, the sheet 20 is wrapped about the cross member 13 so that approximately 370° of material is wrapped about the cross member 13 so as to lock the sheet 20 in the slot 30, as shown in FIG. 7.

Figure 8:
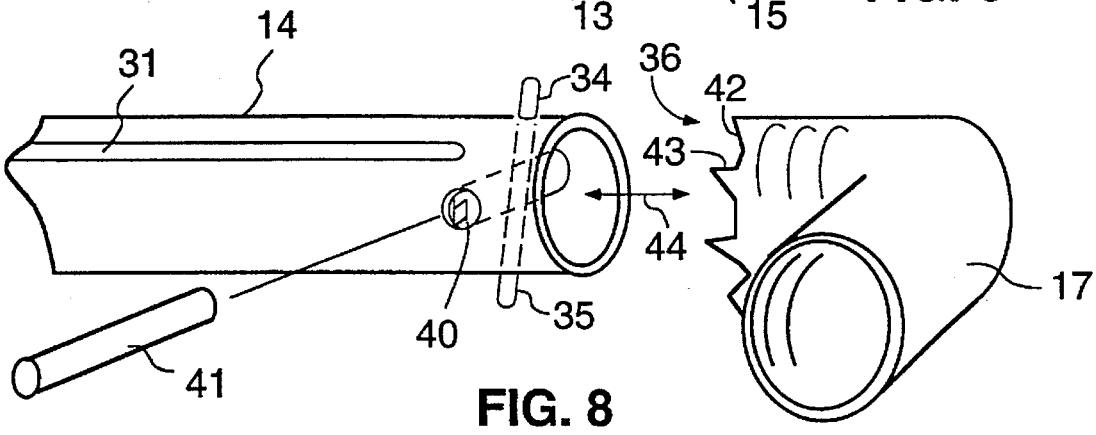
FIG. 8 is an enlarged perspective view of a rotatable slotted cross member and corresponding notched side member fitting according to the present invention.

Referring to FIG. 8, there is shown an enlarged view of the cross member 14 and fitting 17. In addition to the features described above with respect to FIG. 5, the cross member 14 is further provided with a hole 40 for receiving a pin 41. Each of the notches 36 comprises a beveled surface 42 and a straight surface 43.

Figure 7:
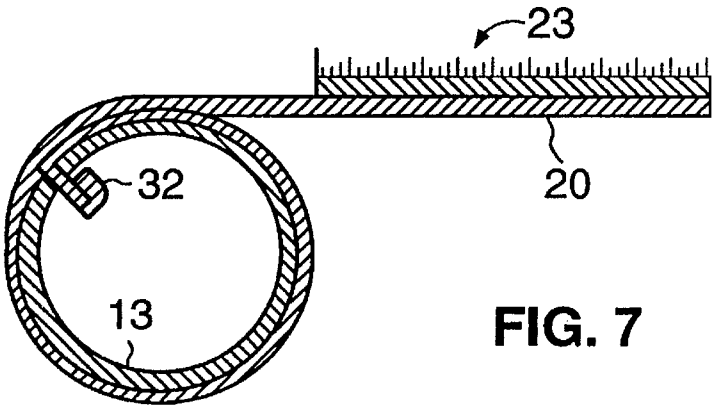
FIG. 7 is a cross-sectional view taken in the direction of lines 8—8 of FIG. 2.

After inserting the hemmed end 33 of the sheet 20 in the slot 31 of the cross member 14 and inserting the pin 41 in the hole 40 provided therefor in the cross member 14, the cross member 14 is rotated in a direction which causes over 360° of material 20 to wrap about the cross member 14 substantially as shown in FIG. 7 with respect to the cross member 13. The pin 41 is used to facilitate the rotation of the cross member 14. As the cross member 14 is rotated, the pins 34 and 35 ratchet in and out of the notches 36 in the fitting 17. When a predetermined or a selected amount of tension has been applied to the sheet 20, the cross member 14 is released and the pins 34 and 35 come to rest against the straight edge 43 of a selected pair of the notches 36. Because the cross member 14 is permitted to rotate freely within the fittings 17 and 18, the fitting 17 moves inwardly and outwardly in a resilient manner in the direction of the arrow 44 as the pin members 34 and 35 are ratcheted from one to another of the notches 36.

Figure 9:
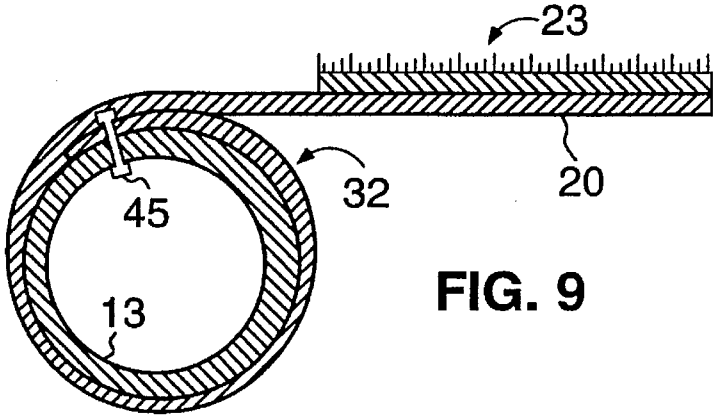
FIG. 9 is a cross-sectional view of another embodiment of a fixed cross member according to the present invention.

Referring to FIG. 9, in an alternative embodiment of the present invention the cross member 13 is provided without a slot and the end 32 of the sheet 20 is attached to the cross member 13 as by an adhesive. If deemed necessary, a rivet 45 may also be used to provide additional holding strength, as shown in FIG. 10.

Figure 10:
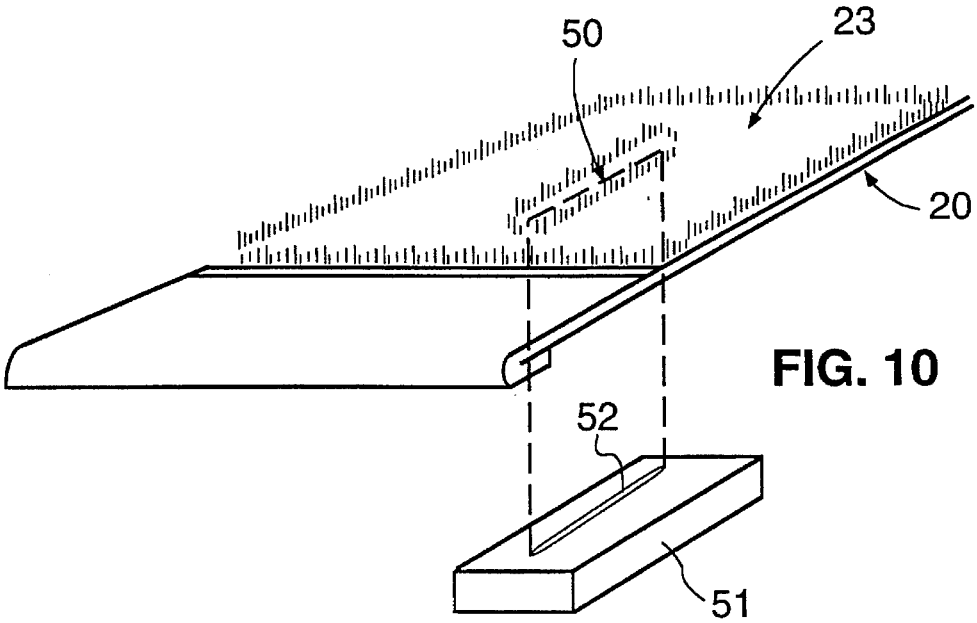
FIG. 10 is a perspective view of a composite sheet of simulated grass material bonded to a sheet of inelastic material to which a tee supporting member is bonded according to the present invention.

Referring to FIG. 10, a slot 50 is provided in the sheet of grass material 23 and supporting sheet 20. Beneath the slot 50 and bonded to the undersurface of the sheet 20 there is provided a block of foam or rubber-like material 51 which may be provided with a slot 52. In use, a wooden or plastic tee is inserted in the slot 50 and projects into the slot 52 in the block 51 which holds the tee in a vertical position in a friction-like manner.

Figure 11:
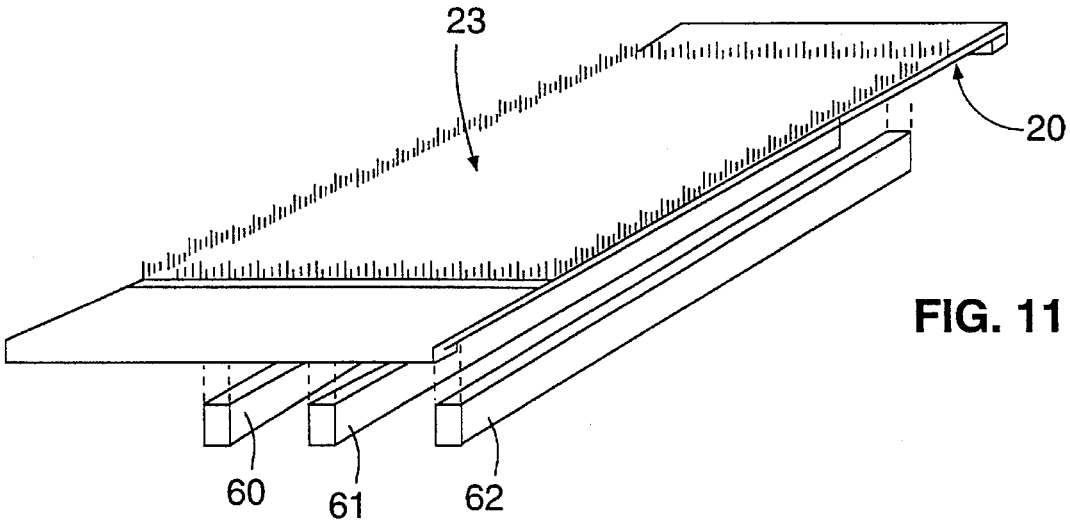
FIG. 11 is a perspective view of a composite sheet of simulated grass material bonded to a sheet of inelastic material to which strips of foam are bonded to resist vertical deformations according to the present invention.

Referring to FIG. 11, there is provided in an alternative embodiment of the present invention a plurality of foam strips 60, 61 and 62 which are bonded to the undersurface of the sheet 20 as by a suitable adhesive so as to provide a degree of resistance to vertical deformation of the sheets 20 and 21 when struck by a golf club. The foam strips typically comprise a rectangular cross-section of 0.75 inch by 1.0 inch, with the smaller dimension being used for bonding the strips to the sheet 20.

Figure 12:
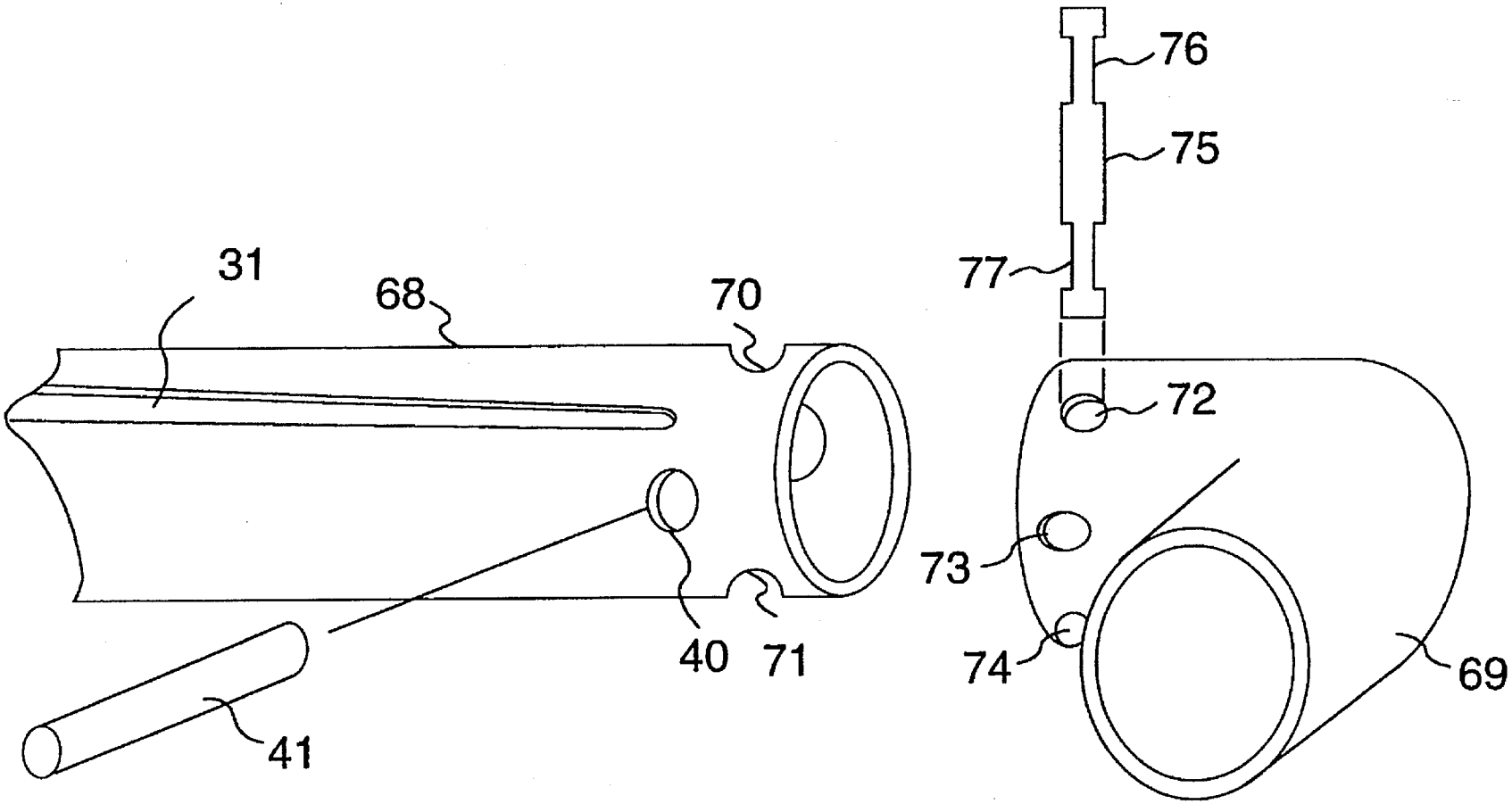
FIG. 12 is an enlarged perspective view of a rotatable slotted cross member and corresponding apertured side member fitting according to another embodiment of the present invention.

Referring to FIG. 12, there is provided in an alternative embodiment of the present invention a rotatable cross member 14 which corresponds to member 14 of FIG. 8 except that there is provided in the member 68 a plurality of holes 70 and 71. In a fitting 17 which corresponds to the fitting 17 of FIG. 8 there is provided a further plurality of holes 72, 73 and 74 with corresponding holes on the opposite sides therefrom.

In use, after the cross member 68 is rotated to the position where a desired amount of tension is applied to the sheet 20, the holes 70 and 71 in the cross member 68 are placed in registration with a corresponding pair of the holes 72, 73 or 74 and a pin 75 is inserted therein to lock the cross member 68 in position. Recesses 76 and 77 are provided in the pin 75 so as to facilitate locking of the pin 75 in the holes 70–74.

Figure 13:
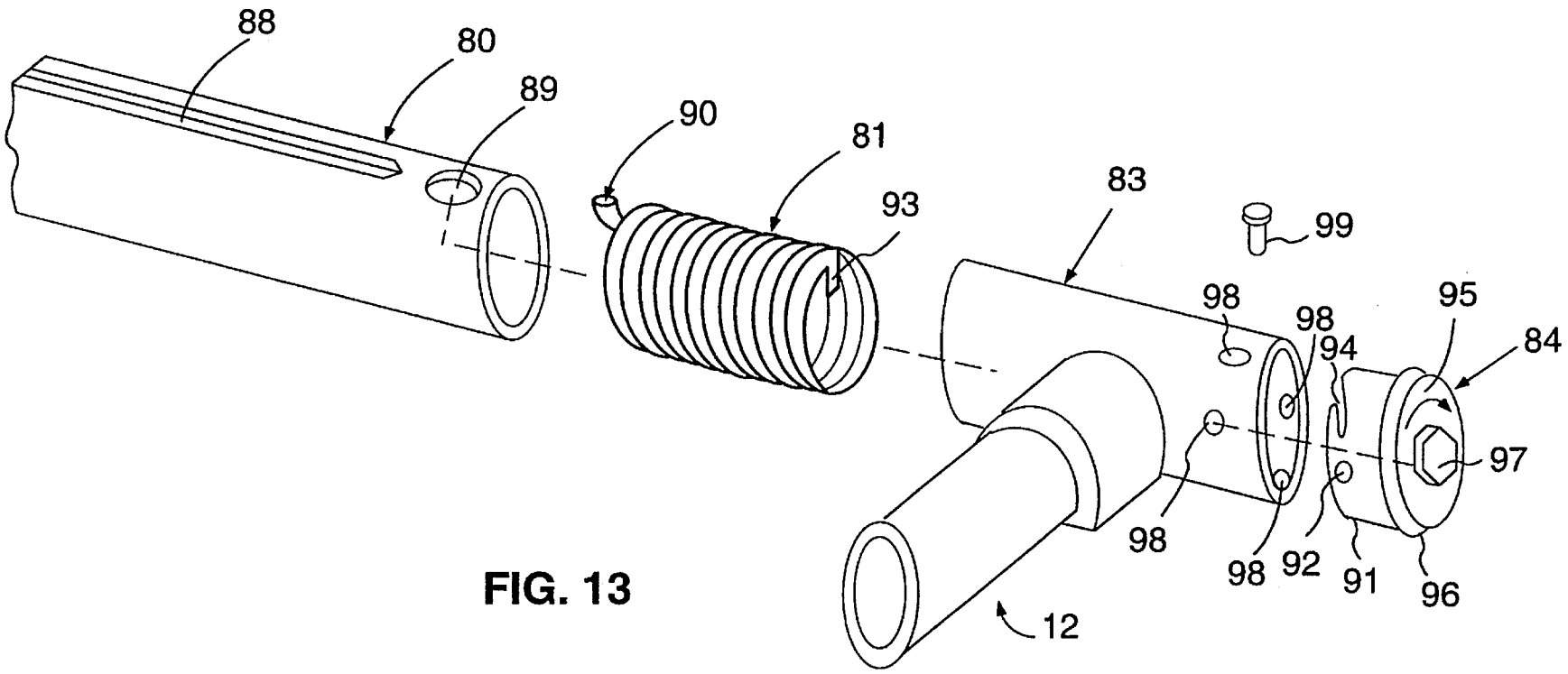
FIG. 13 is an enlarged perspective view of a rotatable slotted cross member and spring tensioning assembly according to another embodiment of the present invention.

Referring to FIG. 13, there is provided in an another embodiment of the present invention a rotatable cross member 80, a spring 81, the side member 12 having a hollow tubular T-shaped fitting 83 at the end thereof and a rotatable end cap 84.

In the cross member 80, which corresponds to member 14 of FIG. 8 and member 68 of FIG. 12, there is provided a slot 88 and a spring receiving hole 89 for receiving and retaining an outwardly projecting end 90 of the spring 81.

In the end cap 84 there is provided an internal tubular portion 91 in which is provided a spring receiving hole 92 for receiving and retaining an inwardly projecting end 93 of the spring 81, an angled slot 94 which is angled in the direction of clockwise rotation of the end cap 84 as shown by the arrow 95, an end cap flange 96 which has a diameter larger than the diameter of the portion 91 for covering the end of the fitting 83 and a hexagonal projection 97 for receiving a wrench, not shown.

In the fitting 83, which corresponds to the fitting 17 of FIG. 8 and the fitting 69 of FIG. 12, there is provided a further plurality of holes 98 for receiving a capped pin 99.

To assemble the apparatus of FIG. 13, the end 90 of the spring 81 is inserted in the hole 89 of the member 80 and the spring 81 and the right end of the member 80 are inserted into the fitting 83. The tubular portion 92 of the end cap 84 is then inserted into the end of the fitting 83 to enable the end 93 of the spring 81 to be captured in the slot 94 of the end cap 84. After rotation of the cap 84 to place the hole 92 in registration with one of the holes 98, the pin 99 is inserted therein to hold the end cap in place.

In use, after the end of the sheet 20 is inserted in the slot 88 as described above with respect to the apparatus of FIGS. 1–12, the cross member 80 is rotated in the direction of the arrow 95 by using a wrench on the projection 97 to a position wherein a desired amount of tension is applied to the sheet 20 and the hole 91 is aligned with one of the holes 98. The pin 99 is then inserted in the holes to hold the sheet 20 under tension. To remove or replace the sheet 20, the tension is released by rotating the member 80 slightly in the direction of the arrow 95, removing the pin 99 and then carefully allowing the spring tension to be relieved by allowing the member 80 to rotate in a direction opposite to the direction of the arrow 95.

In typical embodiments of the present invention the sheet 20 is approximately 32 inches in length and 15 inches wide and the simulated grass sheet 23 is approximately 4 inches shorter on each end thereof. The sheet 20 typically comprises a polypropylene or polyester such as nylon or lexan. Lexan, for example, may be obtained by an extrusion of material 0.015–0.018 inch thick. The hemmed ends 32 and 33 are typically 0.25 inch wide. The amount of tension applied to the sheet 20 is approximately 20 pounds. The side members 11 and 12 and cross members 13 and 14 of FIGS. 1–11, the modified cross member 68 and fitting 69 of FIG. 12 and the modified cross member 80 and fitting 83 of FIG. 13 typically comprise PVC pipe or corresponding metallic pipe and having an outside diameter of approximately one inch, with the interior diameter of the corresponding PVC or metallic fittings 17 and 18, the fitting 69, and the fitting 83 being slightly larger than the outer diameter of the cross members 14, 68 and 80 so as to permit the cross members 14, 68 and 80 to be freely rotated with respect thereto. The cross member 13, on the other hand, is fixedly attached to the fittings 15 and 16, as by an adhesive, solder, or other applicable bonding material. In practice, the resiliency of the component parts of the side members 11 and 12, fittings 15 and 16 and cross member 13 are such that side members of each of the embodiments remain substantially parallel except for a slight outward bending of the member 12 during rotation of the cross member 14 when the pin members 34 and 35 are ratcheted through the notches 36 of the fitting 17.

While preferred embodiments of the present invention are described above, it is contemplated that modifications may be made thereto for particular applications without departing from the spirit and scope of the present invention. Accordingly, it is intended that the embodiments described be considered only as illustrative of the present invention and that the scope thereof should not be limited thereto but be determined by reference to the claims hereinafter provided.

What is claimed is:

1. An apparatus for practicing golf swings comprising:

a pair of spaced parallel side members;

a first cross member attached to an end of each one of the pair of side members;

a second cross member attached to the opposite end of each one of the pair of side members in such a manner that the second cross member is free to be rotated relative to said opposite end of the pair of side members;

a rectangular sheet of substantially inelastic material having on its upper surface a sheet of simulated grass material;

means for attaching one end of the rectangular sheet of material to said first cross member and the opposite end of the rectangular sheet of material to the second cross member; and means for locking the second cross member in position relative to said opposite ends of said side members after a predetermined amount of tension has been applied to the rectangular sheet of material by rotating the second cross member in a direction which results in applying tension to the rectangular sheet of material.

2. An apparatus according to claim 1 wherein said means for attaching corresponding ends of said rectangular sheet of material to said first and second cross members comprises means for removably attaching corresponding ends of said rectangular sheet of material to said first and second cross members.

3. An apparatus according to claim 2 wherein said means for removably attaching corresponding ends of said rectangular sheet of material to said first and second cross members comprises slots in each of said first and second cross members for receiving and retaining corresponding ends of said rectangular sheet of material.

4. An apparatus according to claim 1 wherein said attaching means comprises means for fixedly attaching one end of said rectangular sheet of material to said first cross member and means for removably attaching the opposite end of said rectangular sheet of material to said second cross member.

5. An apparatus according to claim 4 wherein said means for fixedly attaching one end of said rectangular sheet of material to said first cross member comprises an adhesive and said means for removably attaching the opposite end of said rectangular sheet of material to said second cross member comprises a slot in said second cross member for receiving and retaining the corresponding end of said rectangular sheet of material.

6. An apparatus according to claim 4 wherein said means for fixedly attaching one end of said rectangular sheet of material to said first cross member comprises rivets and said means for removably attaching the opposite end of said rectangular sheet of material to said second cross member comprises a slot in said second cross member for receiving and retaining the corresponding end of said rectangular sheet of material.

7. An apparatus according to claim 1 wherein said second cross member comprises a tubular member having a circular cross-section, each of said opposite ends of said side members comprises a fitting to which corresponding ends of said tubular member are fitted for rotation with respect thereto and said locking means comprises means for preventing rotation of said tubular member relative to said fittings.

8. An apparatus according to claim 7 wherein said means for preventing rotation of said tubular member relative to said fittings comprises first locking means near one end of said tubular member and second locking means adapted to engage said first locking means on a corresponding one of said fittings.

9. An apparatus according to claim 8 wherein said first locking means comprises pin means on said tubular member and said second locking means comprises means for engaging said pin means on said corresponding one of said fittings.

10. An apparatus according to claim 9 wherein said pin means comprises a pin member which extends outwardly from said tubular member and said engaging means comprises a notch in said corresponding one of said fittings for engaging said pin member.

11. An apparatus according to claim 10 wherein said notch comprises a sawtooth-shaped notch.

12. An apparatus according to claim 9 wherein said pin means comprises a pin member which extends outwardly from said tubular member and said engaging means comprises a plurality of notches in said corresponding one of said fittings for engaging said pin member.

13. An apparatus according to claim 12 wherein said notches comprise sawtooth-shaped notches.

14. An apparatus according to claim 13 wherein said plurality of notches in said corresponding one of said fittings comprises notches which are spaced approximately 30 degrees apart about the periphery of said corresponding one of said fittings.

15. An apparatus according to claim 9 wherein said pin means comprises pin members which extend radially outwardly from diametrically opposite positions on said tubular member and said engaging means comprises diametrically opposed notches on said corresponding one of said fittings for engaging said pin members.

16. An apparatus according to claim 15 wherein said notches comprise sawtooth-shaped notches.

17. An apparatus according to claim 16 wherein said diametrically opposed notches which are spaced approximately 30 degrees apart about the periphery of said corresponding one of said fittings.

18. An apparatus according to claim 7 wherein said means for preventing rotation of said tubular member relative to said fittings comprises a pin member which is sized to fit within holes provided therefore near one end of said tubular member and the fitting to which said one end is fitted when said holes are placed in registration.

19. An apparatus according to claim 1 wherein said sheet of stimulated grass material comprises:

a rectangular sheet of simulated grass material; and means for attaching said rectangular sheet of simulated grass material to said rectangular sheet of substantially inelastic material.

20. An apparatus according to claim 19 wherein said means for attaching said rectangular sheet of simulated grass material to said rectangular sheet of substantially inelastic material comprises and adhesive.

21. An apparatus according to claim 19 wherein said rectangular sheet of simulated grass material comprises its own separate backing and said means for attaching said rectangular sheet of simulated grass material to said rectangular sheet of substantially inelastic material comprises means for attaching said backing to said rectangular sheet of substantially inelastic material.

22. An apparatus according to claim 21 wherein said means for attaching said backing to said rectangular sheet of substantially inelastic material comprises an adhesive.

23. An apparatus according to claim 1 wherein said rectangular sheet of material comprises means for supporting a golf tee.

24. An apparatus according to claim 23 wherein said tee supporting means comprises a block of material which is bonded to the undersurface of said rectangular sheet of material beneath a slit provided therein for said tee.

25. An apparatus according to claim 1 comprising:

a plurality of elongated strips of material; and means for bonding the strips to the undersurface of said rectangular sheet of material for providing resistance to vertical deformation of said sheet of material when said sheet of material is struck by a golf club.

26. An apparatus according to claim 25 wherein each of said plurality of elongated strips of material comprises a strip of foam material having a cross-section of approximately 1 inch by 0.75 inches.

27. An apparatus according to claim 1 comprising:

a spring member;

means for coupling the spring member to the second cross member; and means for moving the spring member in such a manner so as to rotate the second cross member and apply a desired amount of tension to the rectangular sheet of material attached to the second cross member.

28. An apparatus according to claim 27 wherein said spring member comprises a coiled spring member having an axis parallel to the axis of said second cross member and said moving means comprises means for rotating said spring member about its axis.

29. An apparatus according to claim 28 wherein said means for rotating said spring member about its axis comprises an end cap for covering the end of a fitting to which said second cross member is coupled, said end cap including means for coupling said end cap to said spring member.

30. An apparatus according to claim 29 wherein said means for coupling said end cap to said spring member comprises a tubular portion which is sized to fit within the interior of said fitting and a slot in said tubular portion for engaging an end portion of the spring member.

31. A method of fabricating an apparatus for practicing golf swings comprising the steps of:

attaching first and second cross members to respective opposite ends of a pair of spaced side members in such a manner that the second cross member is free to be rotated relative to said pair of side members;

attaching one end of a rectangular sheet of substantially inelastic material having on its upper surface a sheet of simulated grass material to said first cross member and the opposite end of the rectangular sheet of material to the second cross member; and locking the second cross member in position relative to said side members after a predetermined amount of tension has been applied to the rectangular sheet of material by rotating the second cross member in a direction which results in applying tension to the rectangular sheet of material.

32. A method according to claim 31 wherein said steps of attaching said ends of said rectangular sheet of material to said first and second cross members comprises the step of removably attaching said rectangular sheet of material to said second cross member.

33. A method according to claim 32 wherein said step of removably attaching said rectangular sheet of material to said second cross member comprises the step of inserting the corresponding end of said rectangular sheet of material in a slot in said second cross member.

34. A method according to claim 33 wherein said step of removably attaching a corresponding end of said rectangular sheet of material to said second cross member comprises the step of wrapping said corresponding end of said rectangular sheet of material about said second cross members after said end has been inserted in the corresponding slot.

35. A method according to claim 31 wherein said steps of attaching one end of a rectangular sheet of substantially inelastic material to said first cross member and the opposite end of the rectangular sheet of material to the second cross member comprises the step of fixedly attaching one end of said rectangular sheet of material to said first cross member and the step of removably attaching the opposite end of said rectangular sheet of material to said second cross member.

36. A method according to claim 35 wherein said step of fixedly attaching one end of said rectangular sheet of material to said first cross member comprises the step of attaching one end of said rectangular sheet of material to said first cross member with an adhesive and said step of removably attaching the opposite end of said rectangular sheet of material to said second cross member comprises the step of inserting a corresponding end of said rectangular sheet of material in a slot in said second cross member for receiving and retaining the corresponding end of said rectangular sheet of material.

37. A method according to claim 35 wherein said step of fixedly attaching one end of said rectangular sheet of material to said first cross member comprises the step of attaching one end of said rectangular sheet of material to said first cross member using rivets and said step of removably attaching the opposite end of said rectangular sheet of material to said second cross member comprises the step of inserting a corresponding end of said rectangular sheet of material in a slot in said second cross member for receiving and retaining the corresponding end of said rectangular sheet of material.

38. A method according to claim 31 wherein said step of locking the second cross member in position comprises the step of preventing rotation of said second cross member relative to fittings on corresponding ends of said pair of spaced side members.

39. A method according to claim 38 wherein said step of preventing rotation of said tubular member relative to said fittings comprises the step of engaging corresponding locking members on said second cross member and on a corresponding one of said fittings.

40. A method according to claim 39 wherein said step of locking comprises the step of locking a pin means on said second cross mender in a notch in a corresponding one of said fittings.

* * * * *

UNITED STATES PATENT AND TRADEMARK OFFICE

CERTIFICATE OF CORRECTION

PATENT NO. : 5,456,471

DATED : October 10, 1995

INVENTOR(S) : Donald K. MacDonald

It is certified that error appears in the above-indentified patent and that said Letters Patent is hereby corrected as shown below:

Column 5, line 63, delete "an";
Column 8, line 54, "stimulated" should be --simulated--;
Column 8, line 62, "and" should be --an--;
Column 10, line 61, "mender" should be --member--.

Signed and Sealed this

Fourth Day of June, 1996

Bruce Lehman

*Attest:*

BRUCE LEHMAN

*Attesting Officer*

*Commissioner of Patents and Trademarks*